US006503639B1

(12) United States Patent
Iwaya et al.

(10) Patent No.: US 6,503,639 B1
(45) Date of Patent: Jan. 7, 2003

(54) PRESS-FORMED PRODUCT AND PRESS-FORMING METHOD

(75) Inventors: Jiro Iwaya, Kakogawa (JP); Koichi Kani, Nagoya (JP); Toshiaki Funabiki, Aichi (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/787,406

(22) PCT Filed: Jul. 21, 2000

(86) PCT No.: PCT/JP00/04897

§ 371 (c)(1),
(2), (4) Date: Mar. 21, 2001

(30) Foreign Application Priority Data

Jul. 22, 1999 (JP) ..... 11-207007

(51) Int. Cl.[7] ..... B32B 3/10; B21D 22/02; B26F 1/40

(52) U.S. Cl. ..... 428/573; 428/600; 428/167; 83/880; 83/881

(58) Field of Search ..... 428/573, 600, 428/167; 83/878, 880, 881, 883

(56) References Cited

U.S. PATENT DOCUMENTS 4,233,833 A * 11/1980 Balinski
5,068,964 A * 12/1991 Yabuno et al.
5,111,572 A * 5/1992 Haiml et al.
5,230,939 A * 7/1993 Baum
6,332,644 B1 * 12/2001 Ito et al.

FOREIGN PATENT DOCUMENTS

JP 51-10166 1/1976
JP 55-57327 4/1980
JP 57-64421 4/1982
JP 63-60020 3/1988
JP 1-233019 9/1989

* cited by examiner

*Primary Examiner*—John J. Zimmerman
*Assistant Examiner*—Jason Savage
(74) *Attorney, Agent, or Firm*—Oblon, Spivak, McClelland, Maier & Neustadt, P.C.

(57) ABSTRACT

A press-formed product which is characterized by having a large number of linear concave portions 11 in the region (such as the side wall 31 of the press-formed product 30) which has undergone bending or bending-unbending deformation during press-forming, said linear concave portions satisfying the following requirements.

$$D/P \leqq 0.03 \times t/1.2$$

and $$0.02t < D \leqq 0.5t$$

where, P (mm) is an interval between the linear concave portions 11, D (mm) is a depth of the linear concave portions, and t (mm) is a wall thickness of the press-formed product. A method of producing a press-formed product, said method being characterized by using a die having linear projections on its forming surface in such a way that the edges of said linear projections cut into the blank in the region which has undergone bending or bending-unbending deformation during press-forming, thereby correcting warpage at the same time of press-forming. The press-formed product of the present invention can be obtained by using an ordinary pressing apparatus. The press-forming method of the present invention gives a press-formed product with a good shape.

7 Claims, 9 Drawing Sheets

PRESS-FORMED PRODUCT AND PRESS-FORMING METHOD

TECHNICAL FIELD

The present invention relates to a press-formed product, such as automotive parts, made of steel sheet, and to a method of press-forming such a product. More particularly, the present invention relates to a press-formed product which is nearly free from malformation that otherwise would occur after its release from the forming die, and relates also to a press-forming method for such a press-formed product. (Malformation denotes poor dimensional accuracy resulting from warpage in the wall of formed products or variation in the angle of bent parts of formed products, both due to elastic recovery.)

BACKGROUND ART

A car body is usually constructed of a large number of press-formed products produced from steel sheet by press-forming. These press-formed products are produced by draw-bending. Draw-bending is one way of press-forming with a convex and a concave forming die in combination. These dies are designed such that the convex die moves toward the concave die, thereby press-forming a blank which is held on the concave die under pressure exerted by a blank holder. Thus the blank is shaped between the two dies in conformity with their configuration.

The above-mentioned draw-bending has disadvantages as follows. As the convex die enters the concave die, the blank undergoes bending deformation in the vicinity of the blank holder. As the convex die moves further into the concave die, the blank undergoes unbending deformation. Deformation in this way is called bending-unbending deformation. This deformation produces residual stress in the formed product because the blank is compressed and then stretched as the convex die enters the concave die and the stretched blank is subsequently compressed as the convex die moves further into the concave die. Therefore, the outside of the formed product has a residual tensile stress in the direction of pressing and the inside of the formed product has a residual compressive stress in the direction of pressing. Thus there exists a difference of stress in the thickness direction. Similarly, those specific parts of the formed product, which are deformed by the shoulder of the convex die and which undergo bending alone without unbending, have residual stresses in different directions in their surface. This also causes a difference of stress in the thickness direction.

Those parts which have undergone bending deformation or bending-unbending deformation are subject to elastic recovery after press forming and hence they do not have the dimensions and shape as designed. They present difficulties in assembling and joining (usually by spot welding). Otherwise, their assembly is an imperfect car body with dimensions partly or entirely different from the design. This problem has become more serious in recent years as the result of increasing use of automobile steel sheet having higher strength than before for weight reduction and improved safety and as the result of increasing use of aluminum sheet which is light in weight but has a much lower Young's modulus than steel sheet.

The following three methods have been adopted to address the above-mentioned problem.

(1) A method which consists of applying a tensile force to the side wall in the last stage of forming, thereby causing the formed product to fit with the die. This method is intended to prevent the side wall of the press-formed product from warping.

(2) A method which consists of applying a large compressive force in the thickness direction of the blank in the last stage of forming. This method (called final pressing) is intended to cope with the change in angle of bent parts of the press-formed product.

(3) A method which consists of pushing the punch (convex die) into the center of the blank while firmly holding the periphery of the blank by the blank holder so that the blank will not flow into the concave die. This method is intended to cope with the change in radius of curvature of curved parts of the press-formed product.

The above-mentioned methods, however, have the following disadvantages respectively.

The first method needs a special pressing apparatus or an additional stretching step in the case where an ordinary press is used.

The second method produces only a marginal effect although it is easily practicable with an ordinary pressing apparatus.

The third method, which basically consists of stretching the blank, tends to cause defects (such as rupture) to the blank during forming.

In any way, it is apparent that the conventional methods of eliminating malformation have many problems when they are applied to practical use with an ordinary pressing apparatus.

DISCLOSURE OF THE INVENTION

The present invention has been completed in view of the foregoing. It is an object of the present invention to provide a press-formed product having a good shape easily attainable by an ordinary pressing apparatus. It is another object of the present invention to provide a press-forming method for such a press-formed product.

The first aspect of the present invention is directed to a press-formed product which is characterized by having linear concave portions in the region which has undergone bending or bending-unbending deformation during press-forming, said linear concave portions satisfying the following requirements.

$$D/P \geqq 0.03 \times t/1.2$$

and $$0.02t < D \leqq 0.5t$$

where,

P is an interval between the linear concave portions (mm),

D is a depth of the linear concave portions (mm), and t is a wall thickness of the press-formed product (mm).

The second aspect of the present invention is directed to a method of producing a press-formed product, said method being characterized by using two forming dies in combination, either or both having linear projections on the forming surface, with the first die moving toward the second die in such a way that said linear projections cut into the region which has undergone bending or bending-unbending deformation during press-forming, thereby forming the linear concave portions meeting the above-mentioned requirements.

BEST MODE FOR CARRYING OUT THE INVENTION

For a clear understanding of the present invention, an explanation is given below of the experimental results on which the present invention is based.

It is thought that malformation of press-formed products results mostly from the residual stress or the difference in stress in the thickness direction that occurs in the surface of press-formed products as the result of bending or bending-unbending deformation. It occurred to the present inventors that if press-forming is carried out by using a die having linear projections on its forming surface in such a way that said linear projections cut into the blank being press-formed during press-forming, then the material would move within the surface and undergo compressive deformation in the thickness direction, thereby alleviating or eliminating the residual stress in the surface of the press-formed product or the difference in stress in the thickness direction. This idea was expected to solve problems with malformation. With the above-mentioned finding in mind, the present inventors carried out the following experiment to reduce wall warpage in a U-shaped member formed by draw-bending. Details of this experiment will be explained with reference to FIGS. 10 to 14.

Figure 10:
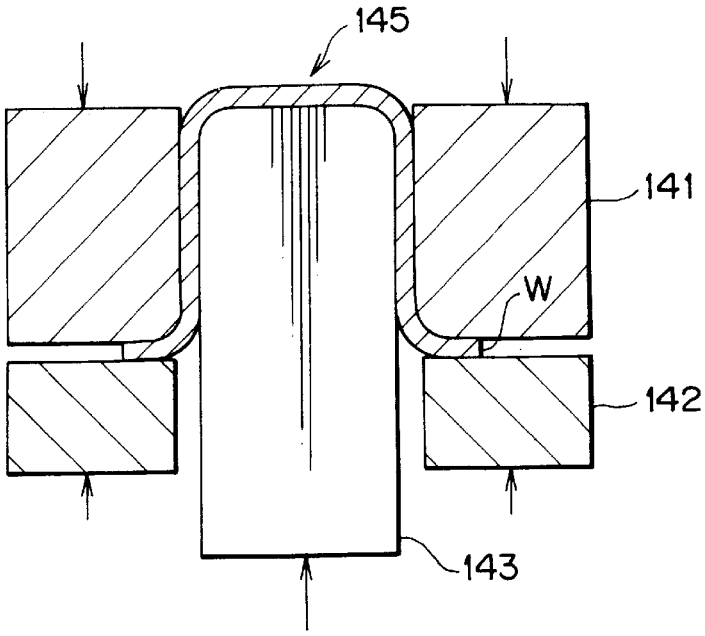
FIG. 10 is a diagram illustrating how a U-shaped member is formed by draw-bending.

FIG. 10 is a diagram illustrating how a U-shaped member is formed by ordinary draw-bending (not pertaining to the method of the present invention). There is shown a U-shaped member which has been formed in such a way that the blank (W) is held between the upper die 141 and the blank holder 142 and the upper die 141 is moved downward so as to cause the lower die (punch) 143 to push into the blank (W) against the upward clamping force exerted by the blank holder 142. The blank (W) is a hot-dip zinc-coated high-tensile steel sheet (440 N class), 1.2 mm thick, 40 mm wide, and 250 mm long. The punch has a bending width (d) of 48 mm and a radius of curvature of 5 mm at its upper end. The pushing depth of the punch is 67 mm and the clamping force of the blank holder 142 is about 1 ton-f. The U-shaped member 145 removed from the die after press-forming assumed a shape as shown in FIG. 12, with its side walls 146 warping outward. This warpage results from the difference in stress that occurred in the thickness direction.

Figure 11:
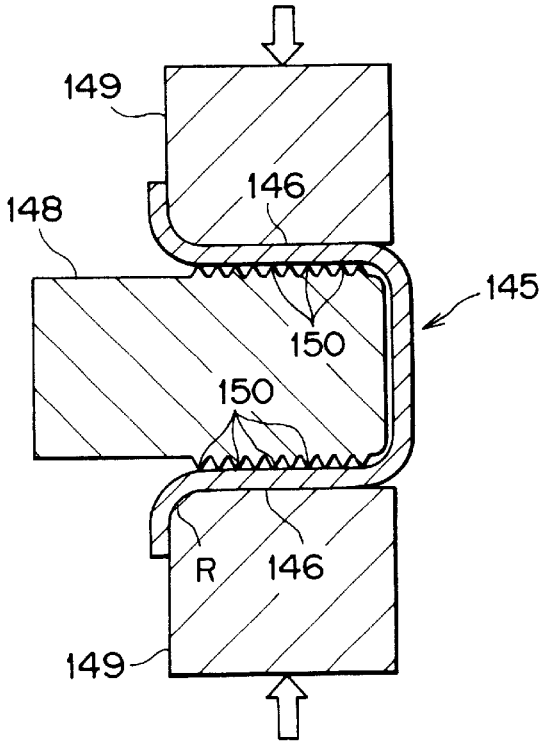
FIG. 11 is a diagram illustrating the press-forming method of the present invention.

For correction of warpage in the side walls 146, the U-shaped member underwent press-forming (according to the method of the present invention) as shown in FIG. 11. This press-forming method consists of holding the side-walls of the U-shaped member 145 between the inner die 148 and the outer dies 149 and 149 and pressing the outer dies in the direction of arrows. The inner die 148 has, on its surface facing the inside of the side wall 146, linear projections 150 each having a cross section of equilateral triangle with a height of 1 mm and running in the widthwise direction of the blank (W). There is another possible embodiment in which the linear projections 150 are formed in the lengthwise direction on that surface of the outer die 149 which faces the outside of the side wall 146. In the following explanation, the term "inside pressing" means pressing by means of the inner die 148 having the linear projections 150 and the flat outer dies 149 and 149, and the term "outside pressing" means pressing by means of the outer dies 149 and 149 having the linear projections 150 and the flat inner die 148. According to this definition, FIG. 11 depicts an example of inside pressing with the inner die 148 having horizontal linear projections 150.

Figure 12A:
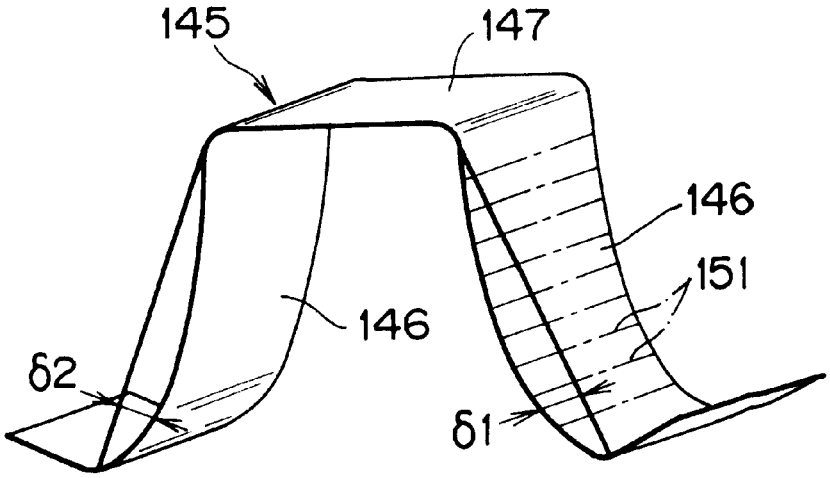
FIG. 12 is a perspective view showing a U-shaped member formed by the press-forming method of the present invention.
Figure 12B:
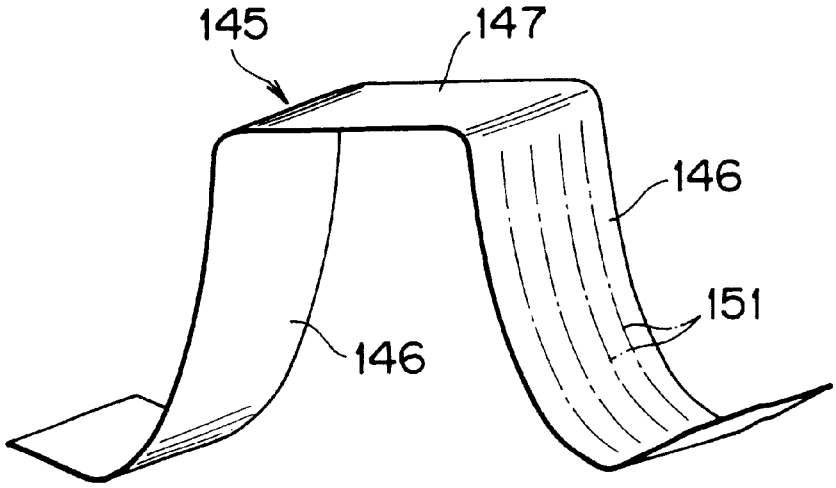

Then, experiments were carried out in the following manner to find out the relation between the D/P ratio and the wall warpage for different wall thicknesses (t), where P denotes the interval (mm) between linear concave portions and D denotes the depth (mm) of linear concave portions. Three kinds of steel sheet blanks W (varying in thickness, t=0.8 mm, 1.2 mm, and 1.6 mm) underwent outside pressing with different pressing forces in such a way that the linear projections 150 cut into the blank W in different depth. The resulting formed product has linear concave portions with different depth D formed in its side wall. The side wall was examined for the amount (δ) of warpage. Incidentally, this experiment employs three kinds of outer dies, each having the linear projections 150 at a horizontal interval (pitch P) of 1 mm, 5 mm, or 10 mm. The U-shaped member obtained by the press-forming method of the present invention is shown in FIG. 12 (perspective view). The side wall 146 has the linear concave portions 151 (indicated by chain lines) which were formed as the linear projections 150 cut into it. FIG. 12(A) shows the linear concave portions 151 formed by the horizontal linear projections 150, and FIG. 12(B) shows the linear concave portions 151 formed by the vertical linear projections 150. The amount (δ) of warpage is defined as the maximum difference between the side wall 146 and the straight line connecting the shoulder of the punch and the end of R of the die shoulder. The value of δ is expressed as an average of two values ($\delta_1$ and $\delta_2$) for both side walls.

The effect of reducing the warpage of the side wall by the present invention is evaluated not by the amount (δ) of warpage mentioned above but by the "ratio of warpage reduction" mentioned later. The reason for this is that the amount (δ) of warpage varies according as the thickness (t) changes (or δ increases as t decreases and vice versa). In this example, the ratio of warpage reduction was used for relative evaluation of three steel sheet blanks varying in thickness (t). The ratio of warpage reduction was calculated as follows.

Ratio of warpage reduction (%)=[($\delta_0$−δ)$\delta_0$]×100 where, $\delta_0$ is the amount of warpage in the case of press-forming by the method not according to the present invention, and δ is the amount of warpage in the case of press-forming by the method according to the present invention.

Figure 14:
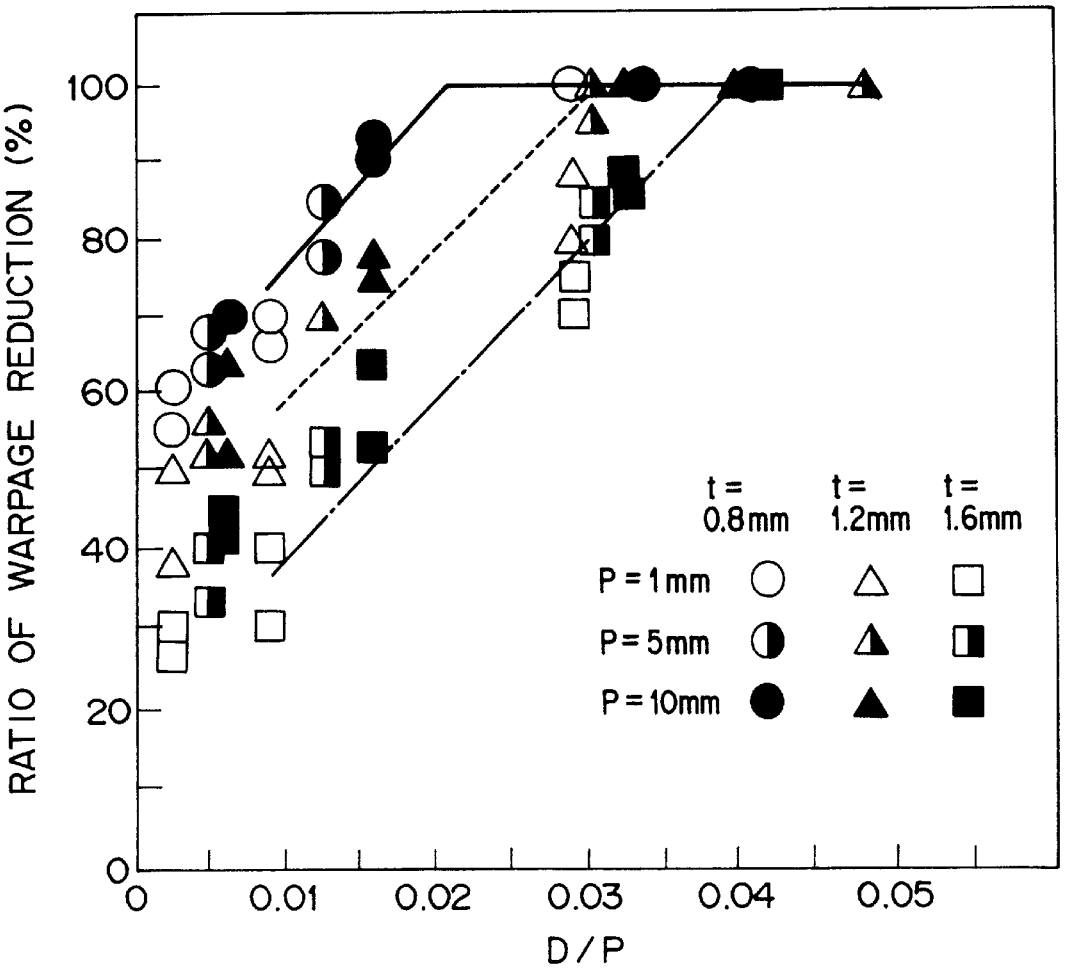
FIG. 14 is a graph showing how the wall warpage depends on the D/P ratio for different thicknesses (t).

The results of the experiment are shown in FIG. 14. It is noted from FIG. 14 that the ratio of warpage reduction depends on D/P and t. In other words, the ratio of warpage reduction can be 100% (or the amount of warpage can be reduced to almost zero) if D/P and t are controlled such that D/P≧0.03×t/1.2.

The relation between D/P and t/1.2 is defined as above for the reasons given below. Warpage results from difference in stress in the cross section of sheet, and the distribution of stress (toward the center) is low in the case of thin sheet and is high in the case of thick sheet. Therefore, the minimum value of D/P depends on thickness (t), and the minimum value of D/P is small in the case of thin sheet and large in the case of thick sheet.

Incidentally, almost the same result as above was obtained when inside pressing was carried out in the same way as above by using an inner die with horizontal linear projections. The same form-correcting result was also obtained in the case of outside pressing or in side pressing by means of an outer die or inner die with vertical linear projections. (not shown)

Figure 13A:
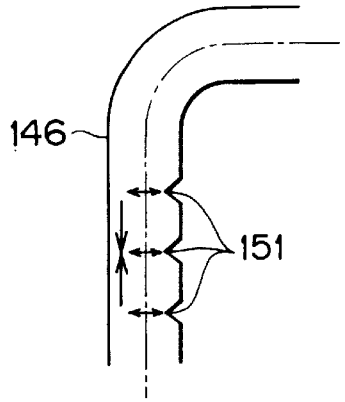
FIG. 13 is a diagram showing how the linear concave portions function.
Figure 13B:
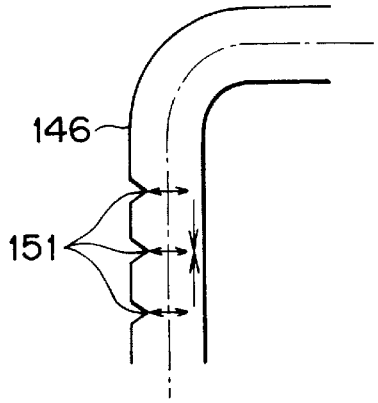

No elucidation has been made of the effect of form correction by the above-mentioned linear concave portions. A probable reason for this is given below. At the time of draw-bending, the U-shaped member undergoes bending-unbending deformation in such a way that compressive residual stress occurs in the inside (facing the punch) of the side wall 146 and tensile residual stress occurs in the outside (facing the die) of the side wall 146. Assume an instance of press-forming in which the linear projections 150 cut into the inside of the side wall 146, thereby forming the linear concave portions 151 (in the widthwise direction or in the direction perpendicular to the pressing direction) as shown in FIG. 13(A). In this instance, compressive deformation takes place in the thickness direction of the side wall 146 and the difference in stress in the thickness direction is alleviated, which allows the side wall 146 to have less warpage after release from the die. On the other hand, assume an instance of press-forming in which the linear projections 150 cut into the outside of the side wall 146, thereby forming the linear concave portions 151 (in the widthwise direction) as shown in FIG. 13(B). In this instance, compressive deformation takes place in the thickness direction of the side wall 146 as the projections cut into and move the material, but this compressive deformation alleviates tensile stress and decreases the difference in stress in the thickness direction, which reduces warpage in the side wall. Assume an instance in which press-forming is carried out in such a way that the linear projections 150 cut into the inside or outside of the side wall 146, thereby forming the linear concave portions 151 in the lengthwise direction of the side wall 146 (in the direction parallel to the pressing direction). [FIG. 12(B) shows an instance in which the linear concave portions 151 are formed on the outside of the side wall 146 in its lengthwise direction.] In this instance, compressive deformation takes place in the thickness direction and hence the difference in stress is reduced, which reduces warpage in the side wall.

The above-mentioned experimental result is the basis of the present invention. The present invention will be described in the following with reference to its specific embodiment.

The gist of the present invention resides in a pres-formed product having linear concave portions press-formed in the region which has undergone bending or bending-unbending deformation at the time of press-forming, characterized in that said concave portions satisfy the following requirements.

$$D/P \geqq 0.03 \times t/1.2,$$

and $$0.02t < D \leqq 0.5t$$

where,

P is an interval between the linear concave portions (mm),

D is a depth of the linear concave part (mm), and t is a wall thickness of the press-formed product (mm).

According to the present invention, the press-formed product has linear concave portions press-formed in the region which has undergone bending or bending-unbending deformation at the time of press-forming. When the concave portions are press-formed, the material moves in the surface of the formed product so as to alleviate or eliminate the residual stress that occurs in the surface of the formed product as the result of bending or bending-unbending deformation or the difference in stress in the thickness direction. This is a probable reason why it is possible to correct malformation resulting from residual stress or difference in stress.

Incidentally, it is not necessary that the above-mentioned concave portions be formed entirely in the region which has undergone bending or bending-unbending deformation. They may be formed only in the region where there occurs a problem with the deformation of the formed product. The concave portions may be formed simultaneously with press-forming that employs a die which has linear projections formed on a specific part of the molding surface (as mentioned later). But they can also be formed by using a pressing roll after press-forming.

According to the present invention, the concave portions are specified such that D/P≧0.03×t/1.2 on the basis of the above-mentioned experimental result. If D/P is smaller than 0.03×t/1.2, the concave portions do not fully produce its correcting effect. The value of D/P should preferably be larger than 0.05×t/1.2.

It is necessary to make adjustment such that the value of D is larger than 0.02t but not larger than 0.5 t. If the value of D is not larger than 0.02t (or the linear concave portions are too shallow), the material does not readily flow in the surface of the formed product and hence the residual stress in the surface remains and the difference in stress in the thickness direction remains, making it difficult to form invariably the linear concave portions as desired. The value of D should preferably be not smaller than 0.04t, more preferably not smaller than 0.07t. On the other hand, if the linear concave portions are too deep, the formed product is severely deteriorated in fatigue strength and impact resistance due to notch effect. In addition, a formed product obtained from plated steel sheet is subject to corrosion because plating film peels off easily. Consequently, the upper limit of the value of D should be 0.5t, preferably 0.4t, more preferably 0.3t.

Incidentally, the present invention does not specifically restrict the thickness (t) of the formed product. The formed product may be produced from any steel sheet (such as cold-rolled steel sheet and hot-rolled steel sheet, with or without plating) or from aluminum sheet. The thickness (t) is about 0.5–6 mm, preferably about 0.5–2 mm.

A preferred embodiment of the present invention is a press-formed product made up of a bottom and side walls formed by bending or bending-unbending deformation, said side walls having press-formed concave portions that satisfy the above-mentioned requirements.

This embodiment is characterized in that the side walls are formed by bending or bending-unbending deformation so that desired linear concave portions are formed therein. These linear concave portions alleviate or remove residual stress that occurs in the surface of the side walls or difference in stress that occurs in the thickness direction when the side walls undergo bending or bending-unbending deformation. As the result, they correct warpage in the side walls that results from residual stress or difference in stress, and in turn they contribute to easy assembling and joining of the press-formed product.

Another preferred embodiment of the present invention is a press-formed product made up of a bottom and a curved wall surrounding it which has undergone bending or bending-unbending deformation, said curved wall having press-formed concave portions that meet the above-mentioned requirements.

This embodiment is characterized in that the curved wall is formed by bending or bending-unbending deformation so that desired linear concave portions are formed therein. These linear concave portions alleviate or remove residual stress that occurs in the surface of the curved wall or difference in stress that occurs in the thickness direction when the curved wall undergoes bending or bending-unbending deformation. As the result, they correct the expanded radius of curvature of the curved wall that results from residual stress or difference in stress. Thus the resulting press-formed product has a curved wall with a desired radius of curvature.

Further another preferred embodiment of the present invention is a press-formed product which is characterized in that the part which has undergone bending or bending-unbending deformation has the linear concave portions meeting the above-mentioned requirements which are press-formed in the direction crossing with the pressing direction (preferably at a right angle).

This embodiment is characterized in that the part which has undergone bending or bending-unbending deformation has linear concave portions crossing with the pressing direction. These linear concave portions divide into sections the residual stress that occurs in the surface of the press-formed product at the time of bending or bending-unbending deformation, thereby alleviating or removing residual stress in the surface or difference in stress in the thickness direction. This in turn effectively corrects malformation.

The following is an explanation of the press-forming method according to the present invention.

The press-forming method according to the present invention consists of moving a first die toward a second die in such a way that the forming surface of the first die and the forming surface of the second die work together to give a press-formed product. The first forming surface and/or the second forming surface has linear projections. At the time of press-forming, the linear projections cut into the region which has undergone bending deformation or bending-unbending deformation, thereby forming the linear concave portions which meet the above-mentioned requirements. This is the feature of the press-forming method. The press-forming method mentioned above forms the press-formed product and the linear concave portions (to correct the shape) at the same time, so that it effectively corrects malformation that occurs in the press-formed product, by using an ordinary pressing apparatus. Therefore, it greatly contributes to productivity. Incidentally, the above-mentioned linear projections may be arranged on the forming surface of either or both of the first die and the second die. In a word, it is only necessary that the linear projections be formed on either or both of the forming surfaces so that they form the linear concave portions which meet the above-mentioned requirements.

Incidentally, in the case where a metal sheet (blank) passes through a plurality of press-forming steps, it is only necessary that the above-mentioned concave portions be formed in any one of the steps. In this way it is possible to carry out press-forming and correction of malformation at the same time by using an ordinary pressing apparatus. This contributes to improved productivity.

A preferred embodiment of the above-mentioned method is one in which the linear projections meeting the above-mentioned requirements are formed on the forming surface which moves relative to the metal sheet at a smaller speed (to be concrete, on the surface of the second die or punch). The advantage of this embodiment is that at the time of press-forming, the slipping of the blank takes place less on the forming surface with the linear projections than on the forming surface without the linear projections, and hence no galling occurs on the forming surface with the linear projections. This contributes to productivity.

The preferred embodiment of the present invention will be explained with reference to FIGS. 1 to 9.

Figure 1:
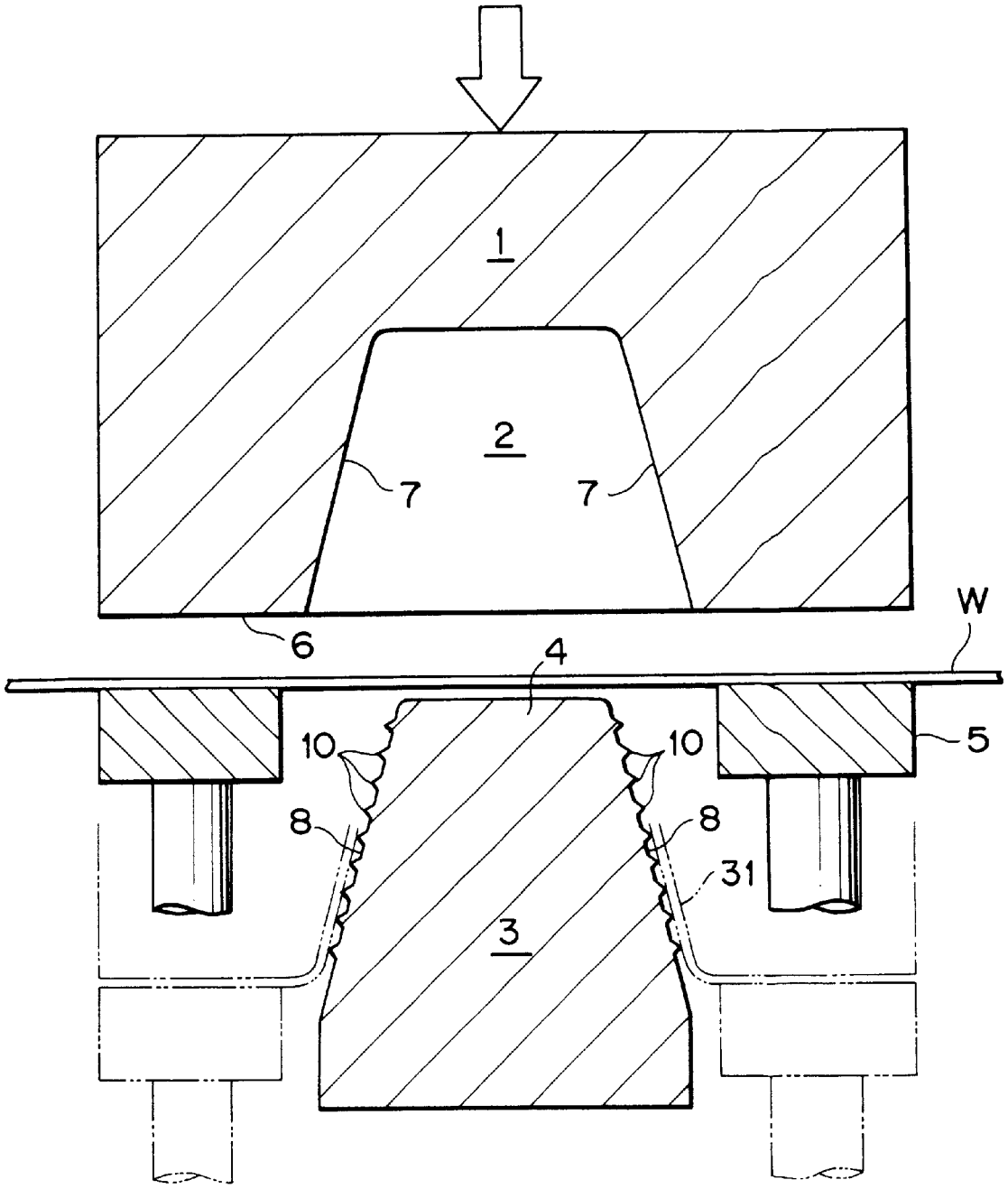
FIG. 1 is a sectional view showing the press-forming die used in the present invention.

FIG. 1 is a sectional view showing the important parts of the press-forming die used to produce the U-shaped member (see FIG. 2) with expanding side walls, which is a press-formed product according to the present invention. The press-forming die consists of an upper female die 1 and a lower male die (punch) 3. The upper die 1 has a concave forming surface 2 facing downward. The lower die 3 has a convex forming surface 4. As the upper die 1 comes close to the lower die 3, the concave forming surface 2 and the convex forming surface 4 work together to form a steel sheet blank W into a desired shape. The lower die 3 is positioned between two blank holders 5 which press the blank W against the bottom surface 6 of the upper die 1. The sides of the concave forming surface 2 correspond to the tapered surfaces 7 and 7, and the sides of the convex forming surface 4 correspond to the tapered surfaces 8 and 8. The tapered surfaces 8 and 8 on the convex forming surface 4 have a large number of linear projections 10 arranged at a prescribed interval (pitch). These linear projections 10 have a triangular cross section and run in the direction perpendicular to the pressing direction.

Figure 2:
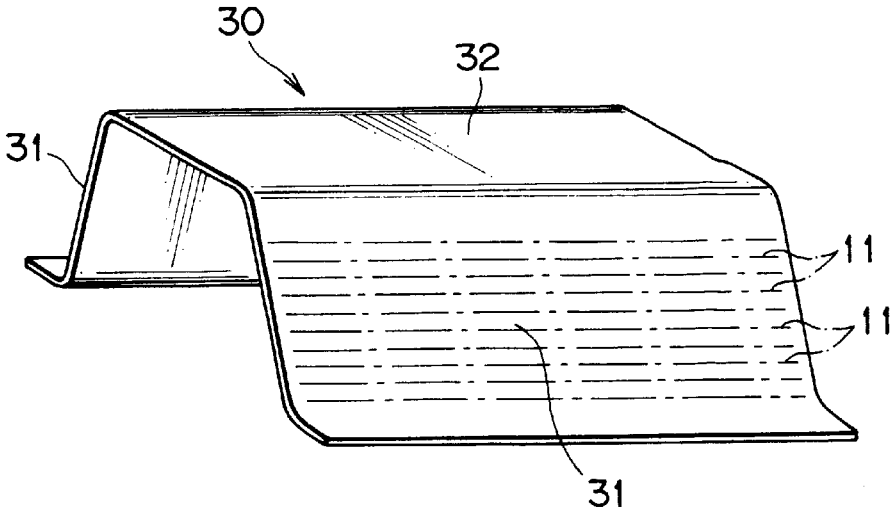
FIG. 2 is a perspective view of a U-shaped member to be formed by the method of the present invention.

Press-forming with the above-mentioned dies is accomplished as follows. First, the upper die 1 is raised to its top dead center and the blank holder 5 is raised to a position for the steel sheet blank W to be inserted, as shown in FIG. 1. The steel sheet blank W is inserted and placed on the blank holder 5. The upper die 1 is lowered so that the steel sheet blank W is held between the blank holder 5 and the bottom surface 6 of the upper die 1. The upper die 1 is lowered further to its bottom dead center in opposition to the force of the blank holder 5, so that the steel sheet blank W is formed in the clearance between the concave forming surface 2 of the upper die 1 and the convex forming surface 4 of the lower die 3. Thus there is obtained a U-shaped member as shown in FIG. 2, which is composed of a bottom 32 (which is formed by the top of the convex forming surface 4) and side walls 31 formed by draw-bending.

The above-mentioned press-forming employs the lower die 3 which has, on its tapered surface 8 of the convex forming surface 4, linear projections 10 which run in the direction perpendicular to the pressing direction. Therefore, when the upper die 1 reaches the bottom dead center, the linear projections 10 cut into the inside of the side wall 31 of the U-shaped member 30, thereby forming, in the surface of the side wall 31, a large number of linear concave portions with a prescribed width at prescribed intervals. The thus formed linear concave portions alleviate the residual stress in the surface of the side wall 31 or the difference in stress in the thickness direction, both occurring as the result of bending-unbending deformation. The U-shaped member 30 released from the die has improved dimensional accuracy, with the side wall 31 having a limited amount of warpage. Incidentally, the linear concave portions 11 formed by the linear projections 10 are represented in FIG. 2 by their center lines running in their lengthwise direction for convenience' sake. In addition, in FIG. 2, the linear concave portions 11 are depicted, for convenience' sake, as if they were on the outside of the side wall 31. In actual, however, they are formed on the inside of the side wall 31. The linear concave portions meet the following requirements.

$$D/P \geqq 0.03 \times t/1.2,$$

and $$0.02t < D \leqq 0.5t$$

where, D is the depth (mm), P is the pitch (mm), and t is the thickness (mm) of the steel sheet blank.

Incidentally, the above-mentioned embodiment is designed such that the linear projections 10 are formed on the tapered side 8 of the convex forming surface 4. However, the embodiment may be modified such that the linear projections 10 are formed on the tapered side 7 of the concave forming surface 2. This embodiment is also within the scope of the present invention. The former embodiment has the advantage of permitting easy press-forming with limited galling. Alternatively, the linear projections 10 may be formed on both the tapered side 8 of the convex forming surface 4 of the lower die 3 and the tapered side 7 of the concave forming surface 2 of the upper die 1. This embodiment is also within the scope of the present invention.

Figure 3:
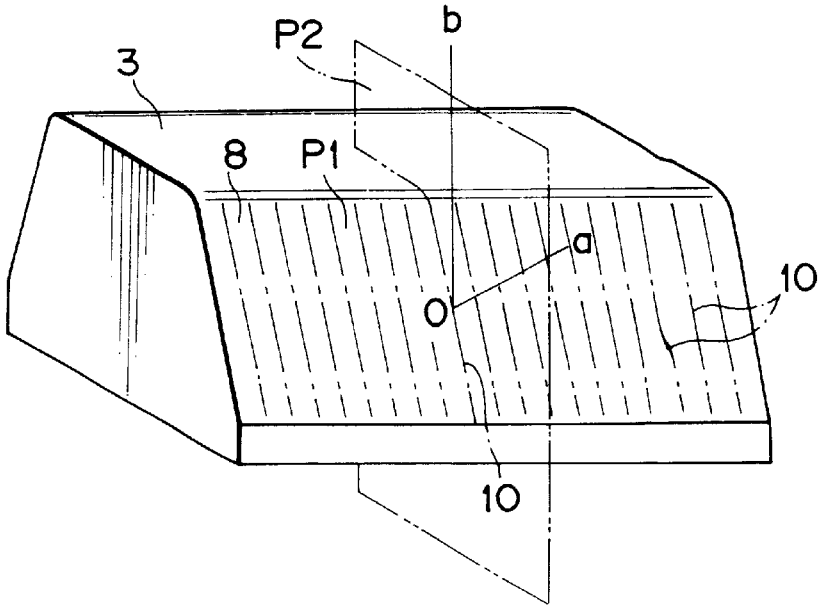
FIG. 3 is a perspective view showing the lower die having linear projections arranged parallel to the pressing direction.

Moreover, it is not always necessary that the linear projections 10 on the tapered side 7 or 8 be formed in the direction perpendicular to the pressing direction as in the above-mentioned embodiment. They may be formed in the direction approximately parallel to the pressing direction along the slope of the tapered side. FIG. 3 is a perspective view showing a lower die which has the linear projections 10 arranged parallel to the pressing direction. The linear projections 10 are represented by their center lines in their lengthwise direction. The lower die shown in FIG. 3 has the linear projections 10 each of which is formed in the following manner. Each of the linear projections 10 passes through the point O on the plane P1 forming the tapered side 8. There is a plane P2 determined by a straight line a passing through the point O and crossing at a right angle with the plane P1 and a straight line b passing through the point O and running parallel to the pressing direction. The plane P1 crosses with the plane P2, forming a line of intersection. The linear projections 10 are formed in the direction of the line of intersection. This embodiment is also within the scope of the present invention. Alternatively, the linear projections 10 may be formed in any direction between the direction perpendicular to the pressing direction (as shown in FIG. 1) and the direction along the slope of the tapered side (as shown in FIG. 3). Alternatively, the linear projections 10 may be formed in both directions. An embodiment in which the linear projections are formed in the direction (almost) perpendicular to and/or (almost) parallel to the pressing direction has an advantage over an embodiment in which the linear projections are formed in arbitrary directions because the former affords ease with which the die is produced.

Figure 4:
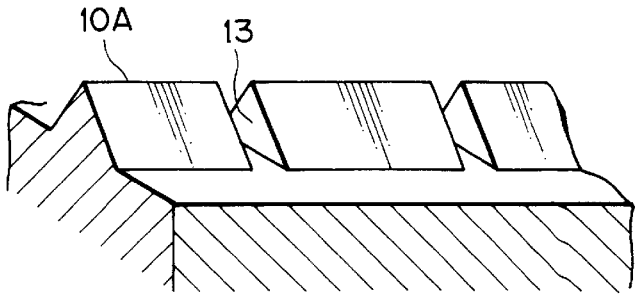
FIG. 4 is a partial sectional perspective view of a linear projections with notches.

According to the present invention, the linear projections are not limited to the continuous ones as mentioned above. Those projections 10A which have notches 13, as shown in FIG. 4, are also acceptable. The linear projections are not restricted in their cross section. The cross section may be triangle (A), truncated triangle (B), round-topped triangle, (C), or peaked shape (D) as shown in FIG. 5. The linear projections with a triangular or approximately triangular cross section easily cut into the surface of the blank because of their sharp edges. This makes the material to flow smoothly in the surface, thereby forming easily and stably the linear concave portions having the desired depth and pitch and the longitudinal cross section mentioned above.

The region in which the linear projections are formed is not restricted to the tapered sides 7 and 8. They may be formed on the shoulder (a transition part from the tapered side 8 to the top flat part of the lower die 3) or on the curve (a transition part from the tapered side 7 to the bottom flat part of the upper die 1). This embodiment permits the desired linear concave part in the curved part 30 of the U-shaped member, so that the difference in stress in thickness direction at the curved part is alleviated or removed and the curved part retains its angle unchanged.

The following is the result of an experiment on press-forming with the die shown in FIG. 1.

Figures 5A, 5B, 5C, 5D:
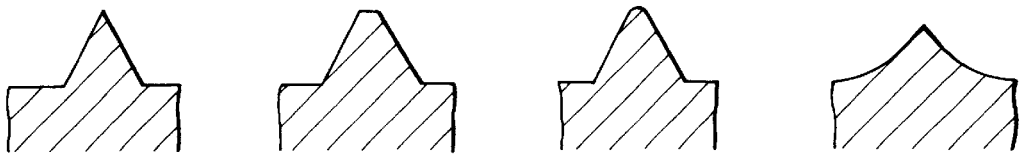
FIG. 5 is a sectional view showing some examples of the linear projections.

Press-forming was carried by using a lower die 3 which has linear projections 10 formed on the tapered side 8. The linear projections 10 have a cross section as shown in FIG. 5(D) and a height of 0.2 mm and a pitch of 3 mm. The blank is a steel sheet (galvannealed hot-dip zinc-coated high-tensile steel sheet) (SGAC 440–45/45) having a thickness (t) of 0.8 mm. This blank was press-formed into a U-shaped member 30 having a depth of 150 mm. Then, the upper die 1 was lowered to its bottom dead center so that the edges of the linear projections 10 cut into the steel sheet blank. Thus there was obtained a U-shaped member having linear concave portions whose depth (D) is 20% of the thickness. (D=0.16 mm, D/P=0.053). The thus obtained U-shaped member 30 has the side walls 31 which are almost free of warpage. This is because it meets the requirements of the present invention (that is, $D/P \geqq 0.03 \times t/1.2$ and $0.02t < D \leqq 0.5t$). The tapered side 8 has an angle of inclination of 5° (which is an angle between the tapered side and the straight line passing through the a point on the tapered side and parallel to the pressing direction).

Incidentally, the press-formed product of the present invention includes not only the above-mentioned U-shaped member but also curved members having a large radius of curvature. Examples of such curved members include doors and roofs. Even such press-formed products have residual stress or difference in stress in the thickness direction in the region which has undergone bending or bending-unbending deformation and hence they usually have a larger radius of curvature than designed.

Figure 6:
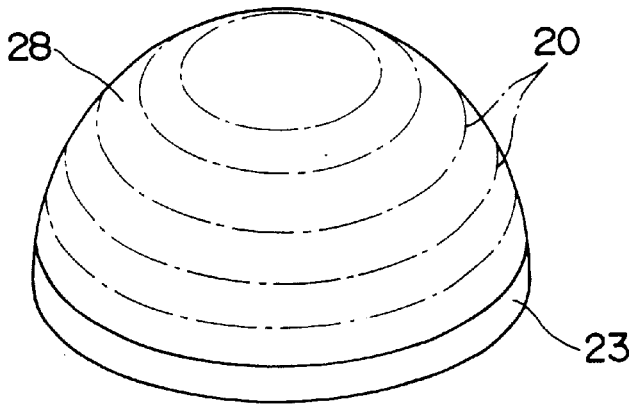
FIG. 6 is a perspective view showing the lower die which has on its top curved surface the linear projections running at a right angle to the pressing direction.
Figure 7:
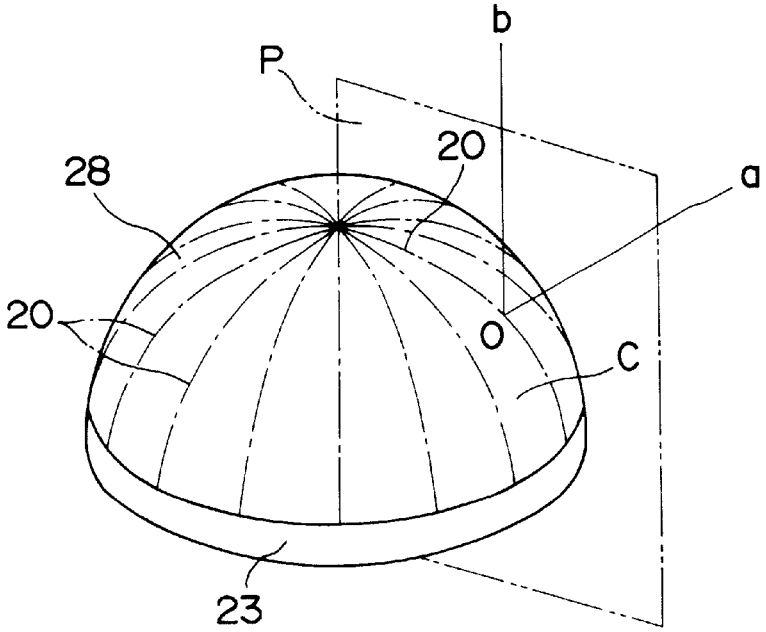
FIG. 7 is a perspective view showing the lower die which has on its top curved surface the linear projections extending in the radial direction from the vertex.

The problem in such a case is solved if press-forming is carried out by using a lower die 23 which has linear projections 20 formed on its curved surface in the direction perpendicular to the pressing direction, as shown in FIG. 6. In FIG. 6 and FIG. 7 (explained later), the linear projections 20 are represented by their center lines running in their lengthwise direction for convenience' sake. The advantage of this embodiment is that the desired linear concave portions are formed on the curved region of the press-formed product which has undergone bending or bending-unbending deformation. This prevents the radius of curvature from expanding. Needless to say, the linear projections 20 are not restricted to those in the above-mentioned embodiment; they may be formed on the curved part of the bottom forming surface of the upper die.

The direction of the linear projections 20 is not restricted to the direction perpendicular to the pressing direction as shown in FIG. 6; it may be in the radial direction extending from the top center of the curved part 28 to the lower peripheral part, as shown in FIG. 7. That is, the linear projection 20 passing through the point O on the curved surface C constituting the curved part 28 may be formed in the direction of line of intersection formed by the curved surface C and the plane P containing the line a passing through the point O and normal to the curved surface C and the line b passing through the point O and parallel to the pressing direction. Alternatively, this linear projections 20 may be formed in combination with the linear projections 20 shown in FIG. 6. At the time of press-forming with such a die, the linear projections 20 cut into the curved part of the press-formed product; therefore, the desired linear concave portions radially expanding from the center of the bottom are press-formed in the curved part.

Incidentally, the above-mentioned embodiment is designed such that the linear projections 10 cut into the blank, thereby forming the linear concave portions, at the same time that the press-formed product is formed in a single step. This embodiment is not intended to restrict the scope of the invention. Therefore, in the case where a metal sheet undergoes press-forming by several steps, it is only necessary to form the desired linear concave portions by using a die having the linear projections as mentioned above in any of the rough forming step (in which the blank is bent into an approximate U-shape) and the finishing step (restriking).

Figure 8:
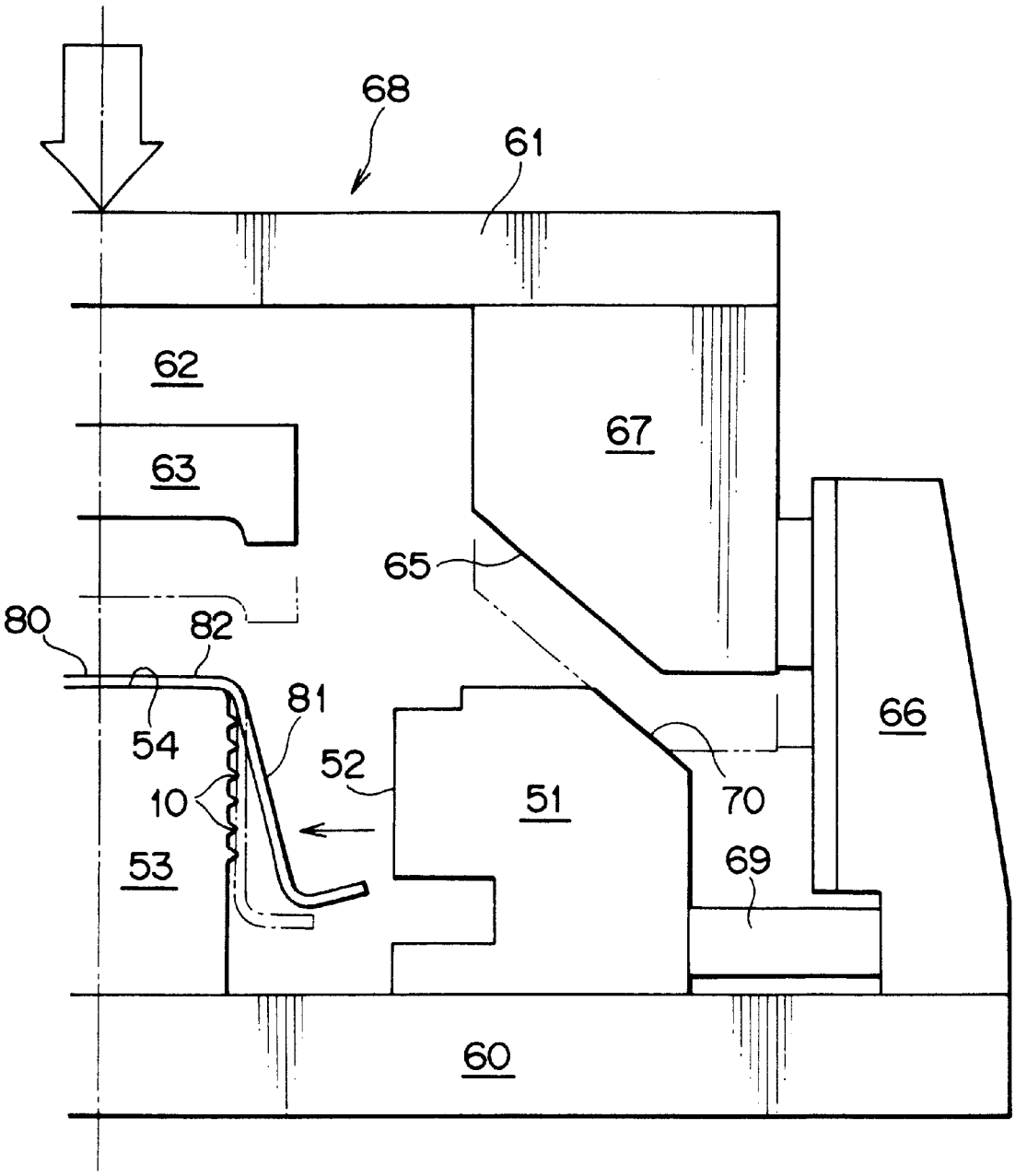
FIG. 8 is a half-front view showing the restriking die (at the time when press-forming is started) used in the present invention.
Figure 9:
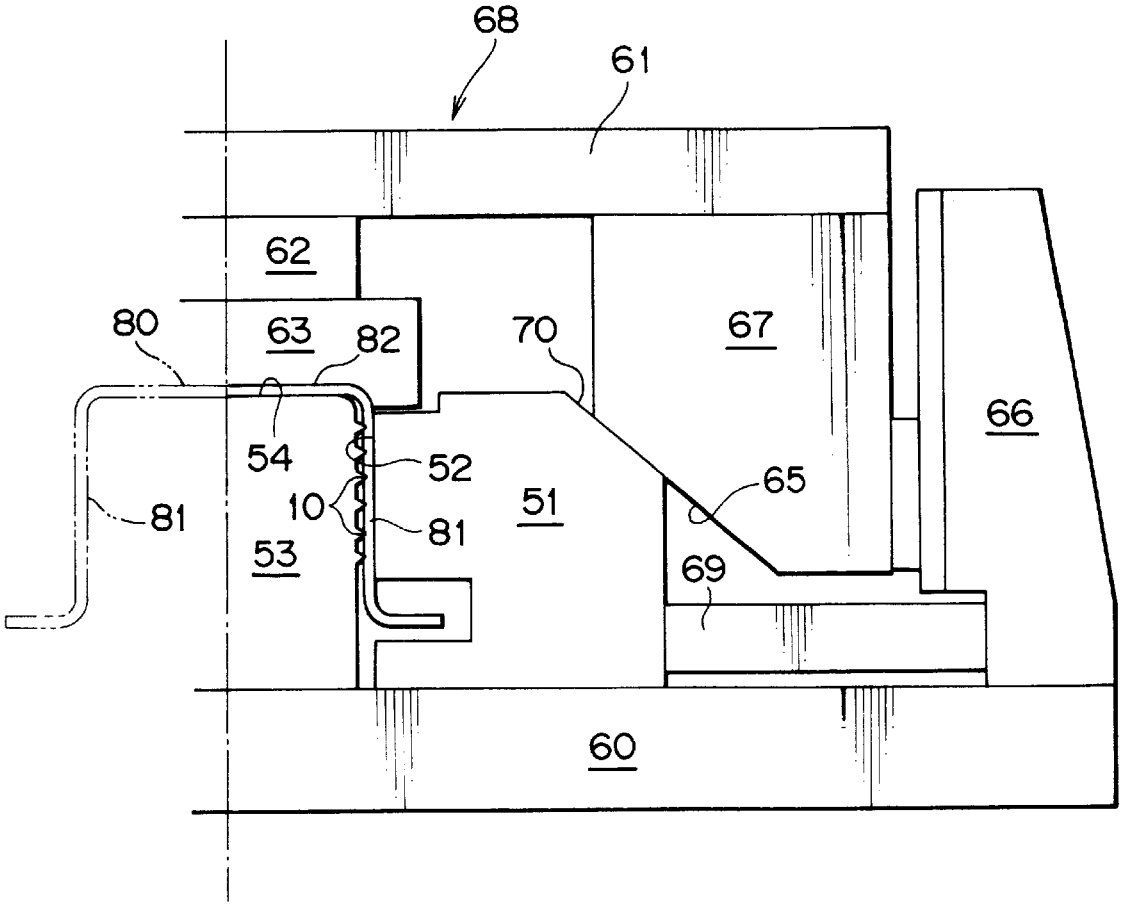
FIG. 9 is a half-front view showing the restriking die (at the time when press-forming is completed) used in the present invention.

The following is an explanation of the method for correcting warpage which has occurred in the side of the press-formed product at the time of rough forming. FIG. 8 is a half-front view showing the restriking die just before the start of press-forming. FIG. 9 is a half-front view showing the restriking die just after the completion of press-forming. This embodiment gives the press-formed product as shown in FIG. 9. This press-formed product is a U-shaped member 80 composed of the bottom 82 and the side walls 81 and 81 which are bent at a right angle.

The restriking die shown in FIG. 8 is composed of a lower die 53, a horizontal die 51, and a drive mechanism 68. The lower die 53 has a convex forming surface 54 which has a square cross section. The horizontal die 51 has a front flat forming surface 52 which performs the finish-forming of the side wall 81 of the U-shaped press-formed product together with the side of the convex forming surface 54 of the lower die 53. The drive mechanism 68 moves the horizontal die 51 toward the lower die 53 along the die base 60. The lower die 53 stands on the die base 60. The side of the convex forming surface 54 has a large number of linear projections 10 arranged at prescribed intervals. They project at a right angle to the pressing direction for draw forming. At the end of the die base 60 stands a heel member 66 which is provided with a restoring member 69 to pull back the horizontal die 51 which has advanced toward the lower die 53.

The above-mentioned drive mechanism 68 is composed of a base member 61 and a cam member 67. The base member 61 moves up and down between the top dead center and the bottom dead center. The cam member 67 moves interlocking with the up and down movement of the base member 61 so as to move the horizontal die 51 back and forth so that the flat forming surface 52 advances to or retreats from the side of the convex forming surface 54 of the lower die 53. The cam member 67 is installed one each at both ends of the base member 61. The cam member 67 has a first tapered surface 65 formed on its lower end. And the cam member 67 moves up and down such that its side slides on the side of the heel member 66 standing on the die base 60. The base member 61 is provided with the holding member 63 which presses down the bottom 82 of the U-shaped member 80 in concert with the top of the convex forming surface 54 of the lower die 53 as the base member 61 goes down to the bottom dead center (or the vicinity of the bottom dead center) via the force-applying member 62 attached to the base member 61. Incidentally, the force-applying member 62 and the restoring member 69 are constructed of an elastic body (such as spring and rubber) or fluid cylinder which expands and contracts greatly.

On the top end of the horizontal die 51 is formed a second tapered surface 70. As the cam member 67 comes down, the first tapered surface 65 formed on the bottom end of the cam member 67 comes into contact with the second tapered surface 70, thereby causing the horizontal die 51 to move toward the side of the lower die 53 in opposition to the force directed to the rear of the restoring member 69. Incidentally, the sliding surface of the member is coated with a wear-resisting material.

The above-mentioned die is used in the following way to perform the finish-forming of the U-shaped member 80. First, the base member 61 of the drive mechanism 68 is raised to its top dead center as shown in FIG. 8. The U-shaped member 80, which has been roughly formed in the previous step and has warpage on its side wall 81, is placed on the lower die 53. Then, the base member 61 is brought down so that the lower surface of the pressing member 63 comes into contact with the upper surface of the bottom 82 of the U-shaped member 80. (The pressing member 63 is held by the base member 61 via the force-applying support member 62. The U-shaped member 80 is placed on the top of the convex forming surface 54 of the lower die 53.) The base member 61 is brought down further to its bottom dead center in opposition to the repulsive force exerted by the force-applying member 62, so that the bottom 82 of the U-shaped member 80 is held under pressure between the pressing member 63 and the top of the convex forming surface 54 of the lower die 53.

On the other hand, the cam member 67 attached to the base member 61 comes down as the base member 61 comes down, so that the first tapered surface 65 of the cam member 67 comes into contact with the second tapered surface 70 of the horizontal die 51. As the base member 61 comes down further, the horizontal die 51 advances to the lower die 53. When the base member 61 reaches its bottom dead center, the flat forming surface 52 on the front side of the horizontal die 51 presses the side wall 81 of the U-shaped member 80 against the linear projections 10 projecting from the side of the convex forming surface 54 of the lower die 53, thereby causing the linear projections 10 to cut into the side wall 81, as shown in FIG. 9. In this way the finish-forming is completed. After that, the base member 61 is brought up, so that the pressing member 63 rises and frees the bottom of the U-shaped member 80. The horizontal die 51 is pulled back to it original position by the restoring member 69. Thus the entire forming process is completed.

The above-mentioned U-shaped member 80 is finished in such a way that the linear projections 10 cut into its side wall 81 to form a large number of linear concave portions in a prescribed depth and at a prescribed interval in the direction perpendicular to the pressing direction of draw forming. These concave portions alleviate the residual stress and the difference in stress in the thickness direction that occur in the surface of the side wall 81. This in turn corrects the warpage of the side wall 81 of the U-shaped member 80 released from the die, and hence the U-shaped member has improved dimensional accuracy.

The restriking forming with the above-mentioned die was evaluated by measuring the amount of warpage. The results are as follows.

The U-shaped member 80 (150 mm deep) was formed by rough bending in the usual way from a steel sheet (galvannealed hot-dip zinc-coated high-tensile steel sheet) (SGAC 440–45/45) having a thickness (t) of 0.8 mm. The resulting U-shaped member 80 suffered warpage in its side wall 81. Then, this U-shaped member 80 was placed in the restriking die. The lower die 53 has a large number of linear projections 10 formed on the side of the convex forming surface 54. The linear projections have a height of 0.2 mm and a pitch of 3 mm and also have a cross section as shown in FIG. 5(D). Then the base member 61 is brought down to its bottom dead center, so that the tips of the linear projections 10 cut into the side 81 of the U-shaped member 80, thereby forming the linear concave portions meeting the requirement that the thickness D is 20% of the thickness t (or D=0.16 mm and D/P=0.053). As the result, warpage in the side 81 of the U-shaped member 80 almost disappeared. This is because the linear concave portions meet the requirement of the present invention, that is, $D/P \geqq 0.03 \times t/1.2$ and $0.02t < D \leqq 0.5t$ Incidentally, the above-mentioned embodiment is characterized in that the linear projections 10 are formed on the side of the convex forming surface 54 of the lower die 53. However, this embodiment is not intended to restrict the scope of the invention. It is permissible that the linear projections are formed on the flat forming surface 52 of the horizontal die 51. In the above-mentioned embodiment, the linear projections are formed in the direction (horizontal) perpendicular to the pressing direction for draw forming. However, it is permissible that the linear projections are formed in the direction (vertical) parallel to the pressing direction or in the oblique direction (intermediate between horizontal and vertical directions).

In addition, the above-mentioned embodiment is characterized in that the horizontal die 51 is moved toward the lower die 53 by the cam member 67 which is actuated as the base member 61 comes down. This embodiment may be modified such that the horizontal die 51 is moved back and forth by a hydraulic cylinder instead of the cam member 67.

Incidentally, the press-forming die used in the present invention may be the one which has any known surface treatment (with chromium coating or ceramics coating) or heat treatment. Also, the pressing apparatus used in the present invention is not specifically restricted. It may be of any type, including hydraulic press, mechanical press, and hydraulic counter press.

Exploitation in Industry

The press-formed product according to the present invention is constructed as mentioned above. It has press-formed linear concave portions in the region which has undergone bending or bending-unbending deformation. These concave portions alleviate the residual stress or the difference in stress in the thickness direction which occur in the surface of the press-formed product as the result of bending or bending-unbending deformation. Therefore, the press-formed product is free from malformation and troubles involved in the assembling and joining of the press-formed products. The effect of eliminating malformation is remarkable particularly in the case where high-tensile thin steel sheet is press-formed for car bodies which need weight reduction and improved safety. Therefore, the press-formed product of the present invention is of great value when applied to automobiles.

The press-forming method of the present invention forms linear concave portions in the region which has undergone bending or bending-unbending deformation, by using an ordinary pressing apparatus at the same time that the shape is formed. Therefore, it is by far superior in productivity when applied to the above-mentioned press-formed product.

What is claimed is:

1. A press-formed product which is characterized by having linear concave portions in the region which has undergone bending or bending-unbending deformation during press-forming, said linear concave portions satisfying the following requirements.

$$D/P \geqq 0.03 \times t/1.2$$

and $$0.02t < D \leqq 0.5t$$

where,

P is an interval between the linear concave portions (mm),

D is a depth of the linear concave portions (mm), and t is a wall thickness of the press-formed product (mm).

2. A press-formed product as defined in claim 1, wherein said linear concave portions meeting said requirements are press-formed in the region which has undergone bending or bending-unbending deformation, with their direction being perpendicular to the pressing direction.

3. A press-formed product as defined in claim 1, wherein said linear concave portions meeting said requirements are press-formed in the side wall thereof.

4. A press-formed product as defined in claim 1, wherein said linear concave portions meeting said requirements are press-formed in the curved surface thereof.

5. A method of producing a press-formed product, said method being characterized by using two forming dies in combination, either or both having linear projections on the forming surface, with the first die moving toward the second die in such a way that said linear projections cut into the region which has undergone bending or bending-unbending deformation during press-forming, thereby forming the linear concave portions meeting the following requirements.

$$D/P \geqq 0.03 \times t/1.2$$

and $$0.02t < D \leqq 0.5t$$

where,

P is an interval between the linear concave portions (mm),

D is a depth of the linear concave portions (mm), and t is a wall thickness of the press-formed product (mm).

6. A press-forming method as defined in claim 5, wherein said linear concave portions are press-formed in any one step when a metal sheet blank is press-formed by a plurality of forming steps.

7. A press-forming method as defined in claim 5, wherein said linear projections meeting said requirements are formed on the first forming surface or the second forming surface, whichever moves more slowly relative to the metal sheet.

* * * * *